US005439773A

United States Patent [19]

Matsui et al.

[11] Patent Number: 5,439,773

[45] Date of Patent: Aug. 8, 1995

[54] ELECTRICALLY-CONDUCTIVE TONER, PROCESS FOR PREPARATION OF SAME, AND PROCESS FOR FORMATION OF IMAGE USING SAME

[75] Inventors: Izuru Matsui; Tsutomu Kubo; Kazuya Furuta; Koichi Takashima, all of Minami-Ashigara, Japan

[73] Assignee: Fuji Xerox Co., Ltd., Tokyo, Japan

[21] Appl. No.: 159,594

[22] Filed: Dec. 1, 1993

[30] Foreign Application Priority Data

Dec. 4, 1992 [JP] Japan ..... 4-350172

[51] Int. Cl.[6] ..... G03G 9/08; G03G 13/16

[52] U.S. Cl. ..... 430/110; 430/126

[58] Field of Search ..... 430/110, 106, 106.6, 430/126

[56] References Cited

U.S. PATENT DOCUMENTS 5,079,123 1/1992 Nanya et al. ..... 430/110
5,266,433 11/1993 Ishida et al. ..... 430/110

FOREIGN PATENT DOCUMENTS 49-4532 1/1974 Japan .
57-501348 7/1982 Japan .
57-179860 11/1982 Japan .
58-66948 4/1983 Japan .
58-145964 8/1983 Japan .
59-148066 8/1984 Japan .
59-162562 9/1984 Japan .
59-184385 10/1984 Japan .
63-106681 5/1988 Japan .
63-135980 6/1988 Japan .

*Primary Examiner*—John Goodrow
*Attorney, Agent, or Firm*—Oliff & Berridge

[57] ABSTRACT

An electrically-conductive toner comprising toner mother grains and a lubricant which is at least one selected from the group consisting of an aliphatic acid, an aliphatic acid metal salt, an aliphatic alcohol, an aliphatic amide, an aliphatic bisamide, and an aliphatic acid ester, the lubricant being in the form of finely divided grains having such a diameter that at least 99% by number of the finely divided grains have a diameter of 3 μm or less.

15 Claims, No Drawings

ELECTRICALLY-CONDUCTIVE TONER, PROCESS FOR PREPARATION OF SAME, AND PROCESS FOR FORMATION OF IMAGE USING SAME

FIELD OF THE INVENTION

The present invention relates to an electrically-conductive toner for use in the development of an electrostatic or magnetic latent image in electrophotography, electrostatic printing or magnetic printing, a process for the preparation of such an electrically-conductive toner, and a process for the formation of an image using such an electrically-conductive toner.

BACKGROUND OF THE INVENTION

Heretofore, a process has been known which comprises forming a latent image on a latent image carrier, developing the latent image with an insulating toner which has been electrically charged by friction with a carrier or a charging member or the like constituting a part of a developing apparatus, electrostatically transferring the toner image onto a medium such as recording paper, and then fixing the toner image on the medium. This process has been widely put into practical use.

This process is disadvantageous in that the frictional chargeability of the insulating toner is governed by the humidity of the atmosphere or the like, making it difficult to obtain a stable image. A process as disclosed in JP-A-49-4532 ( The term "JP-A" as used herein means an "unexamined published Japanese patent application"), which comprises developing a latent image with electric charge induced by an electrically-conductive toner by the action of electrostatic charge on a latent image carrier, is advantageous in that it is little subject to the effect of the humidity of the atmosphere, making it possible to obtain a stable image. However, this process is disadvantageous in that the toner image cannot be electrostatically transferred.

The above process which comprises electrostatic transferring and subsequent fixing is also disadvantageous in that it requires not only a transferring apparatus and a fixing apparatus but also a carrying apparatus for carrying recording paper from the transferring apparatus to the fixing apparatus. This adds to the number of the constituent elements of the recording apparatus, enlarging and complicating the structure of the recording apparatus.

In order to overcome the foregoing difficulties, a simultaneous pressure transfer and fixing process is proposed as disclosed in JP-W-57-501348 (the term "JP-W" as used herein means an "unexamined published international application"), and a simultaneous heat-assisted pressure transfer and fixing process is proposed as disclosed in JP-A-63-106681. These processes do not involve electrostatic transferring and are thus little subject to the effect of the humidity of the atmosphere, enabling development with an electrically-conductive toner. It is also known in the simultaneous pressure transfer and fixing process that it is effective to incorporate an aliphatic metal salt or other lubricants in the toner to prevent maltransferring as disclosed in JP-A-63-135980.

In order to effect the simultaneous transfer and fixing process at a lower pressure, a pressure-fixable microcapsule toner is useful as disclosed in JP-A-59-184385. It is further known that a polymer which stays liquid at a low glass transition temperature or a polymer solution, i.e., pressure-fixable microcapsule toner containing a liquid fixable material in its core as disclosed in JP-A-59-162562 and JP-A-58-145964 is preferably used to provide a higher fixing strength.

However, such a pressure-fixable microcapsule toner having a liquid core is disadvantageous in that part of the liquid core which has flown out from the capsules broken is attached to the latent image carrier at the simultaneous transfer and fixing process and left not thoroughly cleaned out, causing a so-called ghost phenomenon in which the toner is attached to that area at the subsequent development step. In order to inhibit this phenomenon, it is effective to incorporate an aliphatic metal salt or other lubricants in the toner. However, this approach is disadvantageous in that such an additive is separated from the toner while being used with a copying machine or printer, staining the interior of the copying machine or printer. In particular, such an additive which has been separated from the toner and attached to a developing roll enhances the electric resistance of the surface of the developing roll, inhibiting the electrostatic induction to the electrically-conductive toner and hence giving a deteriorated image quality. This approach is also disadvantageous in that the separation of such an additive from the toner causes a change in the resistance of the toner, making it impossible to provide a stable image.

SUMMARY OF THE INVENTION

It is therefore an object of the present invention to provide an electrically-conductive toner in which finely divided lubricant grains added to the toner are not separated therefrom and not attached to a developing roll, inhibiting stain on the interior of a copying machine or printer and image quality deterioration with a lapse of time, and a process for the preparation of such an electrically-conductive toner.

It is another object of the present invention to provide an electrically-conductive toner for a simultaneous pressure transfer and fixing process or a simultaneous heat-assisted pressure transfer and fixing process, which exhibits excellent transferability and fixability and causes no ghost phenomenon, and a process for the preparation of such an electrically-conductive toner.

It is further object of the present invention to provide a process for the formation of an image using the electrically-conductive toner.

Other objects and effects of the present invention will be apparent from the following description.

As a result of extensive studies, the inventors found that an electrically-conductive toner comprising finely divided lubricant grains with extremely reduced diameters incorporated therein does not accumulate frictional electric charge and thus can accomplish the foregoing objects of the present invention.

The present invention relates to an electrically-conductive toner, as a first aspect, comprising toner mother grains and a lubricant which is at least one selected from the group consisting of an aliphatic acid, an aliphatic acid metal salt, an aliphatic alcohol, an aliphatic amide, an aliphatic bisamide, and an aliphatic acid ester, the lubricant being in the form of finely divided grains having such a diameter that at least 99% by number of the finely divided grains have a diameter of 3 $\mu$m or less.

The present invention also relates to an electrically-conductive toner, as a second aspect, comprising toner mother grains and finely divided lubricant grains, the finely divided lubricant grains being obtained by wet-pulverizing a lubricant in the presence of a surface active agent.

The present invention also relates to a process for the preparation of an electrically-conductive toner comprising toner mother grains and finely divided lubricant grains, the process comprising the steps of:

preparing toner mother grains;

wet-pulverizing a lubricant in the presence of a surface active agent to obtain finely divided lubricant grains; and mixing the toner mother grains with the finely divided lubricant grains to cause the finely divided lubricant grains to be attached or fixed to the toner mother grains.

The present invention also relates to a process for the formation of an image which comprises the steps of:

forming a latent image on a latent image carrier;

developing the latent image with a toner; and transferring the developed toner image to a transfer material by means of a pressing member, the toner being at least one of the above-mentioned electrically-conductive toner according to the first and second aspects of the present invention.

DETAILED DESCRIPTION OF THE INVENTION

The electrically-conductive toner according to the present invention comprises finely divided lubricant grains having such a diameter that at least 99% by number of the grains have a diameter of 3 μm or less. Such finely divided grains can be obtained by dry-pulverizing of wet-pulverizing a lubricant using a hummer mill, a turbo mill, a jet mill, a ball mill, an attritor, a sand mill, or a homogenizer.

Since lubricants have a high agglutination power, it is preferred that the surface of the lubricant grains is coated with a surface active agent, so as to prevent agglutination of the lubricant grains. Solid fine grains, such as silica, having a smaller diameter than the lubricant grains may be used instead of the surface active agent. A surface active agent can be coated on the surface of the lubricant grains by wet-pulverizing a lubricant in the presence of a surface active agent, by mechanical force with a V blender or a Henschel mixer, by spray-coating a solution of a surface active agent dissolved in a solvent, or by a flowing bed technique. It is preferred that the surface active agent or the solid fine grains are added upon pulverizing. It is particularly preferred that the lubricant is wet-pulverized in the presence of a surface active agent according to the second aspect of the present invention.

The electrically-conductive toner according to the second aspect of the present invention comprises finely divided lubricant grains obtained by wet-pulverizing at least a lubricant in the presence of a surface active agent.

Examples of the lubricant include an aliphatic acid, an aliphatic metal salt, an aliphatic alcohol, an aliphatic amide, an aliphatic bisamide, an aliphatic ester, and mixtures of two or more of them. Examples of the aliphatic acid include lauric acid, myristic acid, stearic acid, oleic acid, linoleic acid, ricinoleic acid, arachic acid, behenic acid, lignoceric acid, celacholeic acid, and mixtures thereof. Examples of the aliphatic metal salt include salts of a metal such as zinc, cadmium, barium, lead, iron, nickel, cobalt, copper, aluminum, and magnesium with stearic acid; dibasic lead stearate; salts of a metal such as zinc, magnesium, iron, cobalt, copper, lead and calcium with oleic acid; salts of a metal such as aluminum and calcium with palmitic acid; lead caprate; lead caproate; lead linolenate; cobalt linolenate; calcium ricinoleate; salts of a metal such as zinc and cadmium with ricinoleic acid; and mixture thereof. Examples of the aliphatic alcohol include a monovalent or polyvalent alcohol, such as lauryl alcohol, myristyl alcohol, palmityl alcohol, stearyl alcohol, aralkyl alcohol, and behenyl alcohol. Examples of the aliphatic amide include lauric amide, myristic amide, palmitic amide, stearic amide, arachic amide, behenic amide, oleic amide, linoleic amide, linolenic amide, cadleic amide, erucic amide, and celacholeic amide. Examples of the aliphatic bisamide include bislauric amide, bismyristic amide, bispalmitic amide, and bisstearic amide. Examples of the aliphatic ester include esters of aliphatic acid and monovalent alcohol, esters of aliphatic acid and polyvalent alcohol, and partial esters of aliphatic acid and polyvalent alcohol. Among these, metallic salts of stearic acid and aliphatic amides are preferably used.

Examples of the surface active agent include anionic surface active agents such as aliphatic soap, N-acylamino acid and salt thereof, alkylethercarboxylic acid, acylated peptide, alkylbenzenesulfonate, alkylnaphthalenesulfonate, formalin polycondensate of naphthalenesulfonate, dialkylsulfosuccinic ester, alkylsulfoacetate, α-olefinesulfonate, N-acylmethyltaurine, sulfated oil, ester of higher alcohol and sulfuric acid, ester of secondary higher alcohol and sulfuric acid, alkylether sulfate, secondary higher alcohol ethoxysulfate, polyoxyethylene alkyl phenyl ether sulfate, monoglysulfate, ester of aliphatic alkylolamide and sulfuric acid, alkyletherphosphoric ester and alkylphosphoric ester; cationic surface active agents such as aliphatic amine salt, aliphatic quaternary ammonium salt, benzalconium salt, benzetonium chloride, pyridinium salt and imidazolinium salt; amphoteric surface active agents such as carboxybetaine, aminocarboxylate, imidazolinium betaine and lecithin; nonionic surface active agents such as polyoxyethylene alkyl ether, single chain length polyoxyethylenealkylether, polyoxyethylene secondary alcohol ether, polyoxyethylene alkylphenyl ether, polyoxyethylene sterol ether, polyoxyethylene lanolin derivative, ethylene oxide derivative of alkylphenol formalin condensate, polyoxyethylene polyoxypropylene block polymer, polyoxyethylene polyoxypropylene alkyl ether, aliphatic ester of polyoxyethylene glycerin, polyoxyethylenecastor oil, hardened castor oil, aliphatic ester of polyoxyethylenesorbitan, aliphatic ester of polyoxyethylenesorbitol, aliphatic ester of polyethyleneglycol, aliphatic monoglyceride, aliphatic ester of polyglycerin, aliphatic ester of sorbitan, aliphatic ester of propyleneglycol, aliphatic ester of cane sugar, aliphatic alcanolamide, aliphatic amide of polyoxyethylene, polyoxyethylenealkylamide and alkylamine oxide; and fluorine surface active agents. Among these, anionic surface active agents are preferred, with the above-mentioned esters of sulfuric acid being more preferred. These surface active agents may be used singly or in admixture.

The wet-pulverizing as used herein means pulverizing in water or other solvents with a mechanical power. In order to provide such a mechanical power, a ball mill, an attritor, a sand mill or a homogenizer may be used.

The concentration of the surface active agent during the wet-pulverizing is generally in the range of from 0.01% to 10% by weight, preferably from 0.1% to 5% by weight, based on the weight of water or solvent being used for pulverizing. The concentration of the finely divided lubricant grains during the wet-pulverizing is generally in the range of from 0.1% to 50% by weight, preferably from 1% to 30% by weight, based on the weight of water or solvent.

The amount of the surface active agent in the resulting lubricant grains coated with the surface active agent is generally from 0.05% to 10% by weight, preferably from 0.1 to 5% by weight, based on the weight of the lubricant.

It is preferred that at least 99% by number or more of the finely divided lubricant grains obtained by pulverizing have a grain diameter of 3 μm or less. If it is more than 3 μm, the separation of these grains from the toner becomes remarkable. The grain diameter is determined from a 3,000 multiplication photograph of a mixture with the toner mother grains taken by a scanning type electron microscope. Since the finely divided lubricant grains are generally not spherical, its grain diameter is defined as the maximum diameter of the grain on the photograph. 1,000 grains are measured at random. In this case, the grain diameter of aggregates may also be measured.

In order to lower the resistance of the toner to provide an electrically-conductive toner, electrically-conductive grains are generally added to the toner mother grains. Examples of such electrically-conductive grains include finely divided grains of gold, platinum, silver, copper, nickel, tin, aluminum, palladium, iron, lead, zinc, carbon black, graphite, molybdenum sulfide, zinc oxide, titanium oxide, tin oxide, aluminum oxide, indium oxide, silicon oxide, magnesium oxide, barium oxide, molybdenum oxide, and composite oxides thereof. Further, an metallic oxide containing a small amount of heteroatoms may be used. Examples of such electrically-conductive grains include zinc oxide grains containing aluminum, indium, etc., titanium oxide grains containing niobium, tantalum, etc. and tin oxide grains containing antimony, niobium or halogen atoms. The toner mother grains to which the electrically-conductive grains are to be added may be insulating or electrically-conductive by themselves.

The resistance of the toner is measured as follows. A teflon cylinder with an inner diameter of 3 mm having an electrode on the bottom thereof is lightly filled with a small amount of a toner. An opposing electrode is inserted into the cylinder from the upper portion thereof. The opposing electrode is then pressed under a load of about 100 g to press the toner. The amount of-the toner is adjusted such that the pressed height of the toner is about 1 mm. A voltage is then applied across the two electrodes. The resistivity of the toner is determined from electric current flown after 1 minute. That is, the resistivity of the toner is determined under an electric field of $10^2$ V/cm with the voltage changed by several stages with an electrode inserted. The electrically-conductive toner as defined herein means a toner having a resistivity of $10^{12}$ Ωcm or less under an electric field of $10^2$ V/cm.

The addition of the finely divided lubricant grains and electrically-conductive grains to the toner mother grains can be accomplished by any known method. These finely divided grains may be added to the toner mother grains in the form of slurry, and then dried. Alternatively, these finely divided grains may be added to the toner mother grains in the form of dried powder. Further, these finely divided grains may be sprayed over the dried powder of toner mother grains in the form of slurry so that they are dried. In order to add the finely divided lubricant grains in the form of dried powder, it is necessary that they be previously dried.

Examples of the dryers include ventilation dryer, spray dryer, rotary dryer, airborne dryer, fluidized bed dryer, heat transmission dryer, freeze dryer, etc. Any of these dryers may be used. Examples of the means of solid mixing include known various rotary-vessel type mixers, fixed vessel type mixers, and mixers of the type of composite thereof. Any of these mixers may be used.

The amount of the finely divided lubricant grains in the electrically-conductive toner of the present invention is generally from 0.01% to 30% by weight, preferably from 0.1% to 15% by weight, more preferably from 0.1% to 10% by weight, based on the weight of the toner mother grains.

The toner mother grains to be used in the present invention there may be prepared by any method. An electrically-conductive toner containing magnetic grains and a microcapsule toner comprising a core material and a shell covering the core material are preferably used. As the microcapsule toner, a microcapsule toner containing a liquid fixing material in its core is particularly preferred because of its excellent fixability.

The preparation of the toner mother grains can be accomplished by any known method. For example, microcapsule toners can be obtained by any known capsulization technique such as interfacial polymerization, phase separation and in-situ polymerization. From the standpoint of easiness of forming shell, perfection of coating and mechanical strength of shell, capsulization method by interfacial polymerization is preferred. The preparation of capsules by interfacial polymerization can be accomplished by any known method as disclosed in JP-A-57-179860, JP-A-58-66948, JP-A-59-148066, and JP-A-59-162562. As the shell component to be obtained by interfacial polymerization, polyisocyanates or polyurethanes or polyureas made of polyisocyanate and polyol or polyamine, or copolymers thereof are particularly preferred.

Examples of the polyisocyanates include 2,4-tolylene diisocyanate, 2,6-tolylene diisocyanate, diphenylmethane diisocyanate, polymeric diphenylmethane diisocyanate, hydrogenated diphenylmethane diisocyanate, 1,5-naphthalene diisocyanate, 3,3'-dimethyldiphenyl-4,4'-diisocyanate, hexamethylene diisocyanate, isophorone diisocyanate, m-phenylene diisocyanate, p-phenylene diisocyanate, transcyclohexane-1,4-diisocyanate, diphenylether diisocyanate, xylylene diisocyanate, hydrogenated xylylene diisocyanate, 2,6-diisocyanatecaproic acid, tetramethyl-m-xylylene diisocyanate, tetramethyl-p-xylylene diisocyanate, trimethylhexamethylene diisocyanate, triphenylmethane triisocyanate, tris( isocyanatephenyl )thiophosphate, isocyanatealkyl-2,6-diisocyanatecapronate, 1,6,11-undecanetriisocyanate, 1,8-diisocyanate-4-isocyanatemethyloctane, 1,3,6-hexamethylene triisocyanate, and bicycloheptane triisocyanate. Further examples thereof include modified urethanes made of these polyisocyanates and monomeric polyols, adducts of these polyisocyanates with trimethylolpropane, urethane prepolymers made of these polyisocyanates and polyether polyol or polyester polyol, modified urethidions, modified isocyanurates, modified carbodiimides, modified urethoneimines, modified allophanates, and modified buret.

Examples of the polyol include ethylene glycol, propylene glycol, glycerin, trimethylol propane, pentaerythritol, bisphenol A, polyether polyol, and polyester polyol.

Examples of the polyamine include ethylenediamine, hexamethylenediamine, diethylenetriamine, triethylenetetramine, tetraethylenepentamine, 2-methylpentamethylenediamine, phenylenediamine, xylylenediamine, diphenylmethanediamine, diethyltoluenediamine, t-butyltoluenediamine, piperazine, 2,5-dimethylpiperazine, and 1,4(bis-3-aminopropyl)piperazine. Further, a polyether polyamine obtained by amino-terminating a polyol may be used. Such a polyether polyamine is commercially available as Jeffermine D-230, D-400, D-2000 and T-403 from Mitsuishi Texaco Chemical Co. Instead of polyol or polyamine, water may be used.

Examples of the formation of microcapsules by interfacial polymerization will be further described hereinafter. The formation of microcapsules by interfacial polymerization is accomplished by a process which comprises mechanically suspending an oily mixture of a fixing component, a magnetic powder, a colorant, a polyisocyanate, etc. in a dispersion medium such as water with a dispersant, and then adding a polyol or polyamine to the dispersing medium. Alternatively, a fixing component may be provided by forming a capsule containing a monomer, and then polymerizing the monomer.

Examples of the fixing component include a resin such as styrene polymer, styrene-butadiene copolymer, epoxy resin, polyester, rubber, polyvinylpyrrolidone, polyamide, coumarone-indene copolymer, methyl vinyl ether-maleic anhydride copolymer, amino resin, polyurethane, polyurea, polymer or copolymer of acrylic ester or methacrylic ester, copolymer of acrylic acid or methacrylic acid with acrylic ester or methacrylic ester, polyvinyl acetate, and polyvinyl chloride. Particularly preferred among these resins are styrene polymer, and polymer or copolymer of acrylic ester or methacrylic ester. These resins may be used singly or in admixture. Among these resins, those which are not liquid at normal temperature, i.e., have no fluidity, are preferably used with a plasticizer or in the form of solution or dispersion in any proper high boiling point solvent.

Examples of the plasticizer include phosphates such as tributyl phosphate and triphenyl phosphate; phthalates such as dibutyl phthalate and di-n-octyl phthalate; aliphatic monobasic esters such as butyl oleate and glycerinmonooleate; aliphatic dibasic esters such as di-n-hexyl adipate and dibutyl sebacate; divalent alcohol esters such as diethyleneglycol dibenzoate and triethyleneglycol di-2-ethylbutyrate; hydroxycarboxylates such as butylphthalylbutyl glycolate and tributyl acetylcitrate, chlorinated paraffin; chlorinated biphenyl; 2-hintrobiphenyl; dinonyl naphthalene; o-toluenesulfone ethylamide; p-toluenesulfone ethylamide; camphor; and methyl abletare.

Examples of the high boiling point solvent include phthalates such as diethyl phthalate and dibutyl phthalate; aliphatic dicarboxylic esters such as diethyl malonate and dimethyl oxalate; phosphates such as tricresyl phosphate and trixylyl phosphate; citrates such as o-acetyltriethyl citrate and tributyl citrate; benzoates such as butyl benzoate and hexyl benzoate; alkylnaphthalenes such as methyl naphthalene, monoisopropyl naphthalene and diisopropyl naphthalene; alkyldiphenylethers such as o-, m- and p-methyldiphenylether; higher aliphatic or aromatic sulfonic amide compounds such as N,N-dimethyllauroamide and N-butylbenzenesulfonamide; trimellitates such as trioctyl trimellitate; diarylalkanes such as dimethylphenylphenylmethane, 1-phenyl-1-methylphenylethane, 1-dimethylphenyl-1-phenylethane and 1-ethylphenyl-1-phenylethane; and aliphatic saturated hydrocarbons.

The capsule toner may contain a magnetic powder incorporated therein. The magnetic powder to be contained in the toner may be incorporated in the core material or shell. Examples of the magnetic powder include magnetite, ferrite, cobalt, iron, nickel, etc., singly or in the form of alloy thereof. These magnetic powders may be subjected to surface treatment with a silane coupling agent, a titanium coupling agent or other organic or inorganic materials before use.

The colorant may be incorporated in the core material or shell of the microcapsule toner or may be added to the exterior of the microcapsules. Examples of the colorant include inorganic pigments such as carbon black, colcothar, Prussian blue and titanium oxide; azo pigments such as fast yellow, disazo yellow, pyrazolone red, chelate red, brilliant carmine and parabrown; phthalocyanine pigments such as copper phthalocyanine and metal-free phthalocyanine; and condensed polycyclic pigments such as flavanthrone yellow, dibromoanthrone orange, perylene red, quinacridone red and dioxazine violet. Dispersed dyes, oil-soluble dyes, etc. may also be used. Alternatively, the magnetic powders may be used as colorants.

Examples of the dispersant include water-soluble high molecular compounds such as gelatin, gum arabic, sodium arginate, casein, methyl cellulose, carboxymethyl cellulose, hydroxyethyl cellulose, hydroxypropylmethyl cellulose, polyacrylic acid, vinylbenzenesulfonic acid copolymer, starch and polyvinyl alcohol; and finely divided grains of inorganic materials such as colloidal silica, colloidal alumina, tribasic calcium phosphate, aluminum hydroxide, ferric hydroxide, calcium carbonate, barium carbonate, barium sulfate and bentonite.

The dispersing medium or oily mixture may contain a surface active agent incorporated therein. As the dispersing medium, water is generally used. Alternatively, ethylene glycol, glycerin, butyl alcohol, octyl alcohol or mixture thereof may be used.

The electrically-conductive toner according to the present invention can be effectively applied in the simultaneous pressure transfer and fixing process and simultaneous heat-assisted pressure transfer and fixing process, as well as in an image formation apparatus using a simultaneous heat transfer and fixing process. In the pressure fixing process, the electrically-conductive toner according to the present invention does not cause offset on the fixing roll.

The process for the formation of an image with the electrically-conductive toner according to the present invention will be further described hereinafter. In the image formation process according to the present invention, a latent image is formed on a latent image carrier such as photoreceptor and an electrostatic recording material. Examples of the latent image carrier include a selenium photoreceptor, organic photoreceptor or amorphous silicon photoreceptor which may be optionally overcoated or material which has heretofore been known as a latent image carrier, such as polyethylene terephthalate and electrostatic recording material having a dielectric material such as anodized aluminum. The latent image thus formed is then developed with the foregoing electrically-conductive toner. The toner image thus formed by development is transferred to a transfer material where it is then fixed.

In the present invention, where a capsule toner is used as electrically-conductive toner, transfer and fixing can be effectively effected not only by the simultaneous pressure transfer and fixing process or the simultaneous heat-assisted pressure transfer and fixing process but also by the simultaneous heat transfer and fixing process. In the transfer process, a pressing member is used as the transfer material. In particular, the pressing member is preferably a transfer material having a heating means thereinside.

Most of commercially available lubricant grains have the same or larger grain diameter than that of toner grains or are apt to form aggregates whose grain diameter is the same as or larger than that of toner grains. Even if these lubricant grains are mixed with the toner grains so that they are attached to the toner grains, they can be easily separated therefrom while being used in a developing machine. In order to inhibit this phenomenon, it is necessary to reduce the diameter of the lubricant grains. Further, the inventors observe that while the toner is carried over a development roll, the lubricant is electrically charged due to friction with the development roll and then separated from the toner mother grains and attached to the development roll. Thus, if the lubricant is separated-from the toner mother grains and then attached to the development roll, it enhances the electric resistance of the surface of the development roll, inhibiting the induction of electric charge into the electrically-conductive toner and hence deteriorating the image quality. Further, when a lubricant which is insulating or highly resistive is separated from the toner mother grains, the resistivity of the toner changes, causing a problem that a stable image cannot be obtained.

When a lubricant is pulverized to extremely small grain diameter, for example, pulverized in the presence of a surface active agent, the interface created by pulverizing is stabilized, making it possible to obtain lubricant grains having a small grain diameter. Further, this process provides finely divided lubricant grains having a surface active agent attached thereto. The finely divided lubricant grains have a reduced resistivity and hence do not accumulate electric charge thereon under friction of the development roll. Thus, the finely divided lubricant grains are not attached to the development roll. Toner mother grains having an insulating or highly resistive lubricant attached to the surface thereof show a resistivity change when the lubricant is separated therefrom. However, toner mother grains comprising the finely divided lubricant grains according to the present invention cause no such a trouble.

The present invention will be further described in the following examples, but the present invention should not be construed as being limited thereto.

EXAMPLE 1

Preparation of capsule grains

Into a 2-l polyethylene container were charged 120 g of lauryl methacrylate (GE-410, available from Mitsubishi Gas Kagaku K.K.), 3.0 g of azobisisobutylonitrile (ABN-R, available from Nihon Hydrazine Kogyo K.K. ), 50 g of a liquid diphenylmethanediisocyanate (Isonate 143L, available from Mitsubishi Kasei Dow Co., Ltd.), and 20 g of dichloromethane. These materials were then thoroughly stirred by means of a polytrone homogenizer (available from Kinemachika K.K.). To the mixture was then added 300 g of a magnetic powder of triiron tetraoxide (EPT-1000, available from Toda Kogyo K.K.). The mixture was then vigorously stirred by means of a polytrone homogenizer (Kinemachika K.K.) to disperse the magnetic powder therein. To the dispersion was then added 1 kg of a 0.15% aqueous solution of a polyvinyl alcohol (PVA220, available from Kuraray Co., Ltd. ). The mixture was then stirred at 10,000 rpm for 1 minute by means of a polytrone homogenizer (Kinemachika K.K.) to obtain an O/W emulsion containing oil droplets having an average grain diameter of 12 μm. This emulsion was then immediately transferred into a 3-l flask. To the emulsion was then added 100 g of a 20% aqueous solution of diethylenetriamine (TEXLIN DETA, available Mitsuishi Texaco Chemical K.K.). The mixture was then stirred for 1 hour by means of an agitator equipped with propeller blades (Three-One Motor, available from Shinto Kagaku K.K.) to form a shell on the surface of the oil droplets. Thus, capsule grains were obtained.

The capsule grains were then heated to a temperature of 90° C. at a rate of 1° C. per minute over an oil bath. The material was then further heated for 5 hours so that the lauryl methacrylate monomer in the capsules were polymerized. After allowed to cool, the suspension of capsule grains was transferred into a 4-l beaker. The suspension was then diluted with an ion-exchanged water with stirring to make 4 l. The material was then allowed to stand. After the capsule grains were sedimented, the supernatant fraction was then removed. This procedure was repeated seven times to wash the capsule grains. The capsule grains were then passed through a 75-μm mesh sieve to remove coarse grains. To the resulting capsule grain suspension was then added an ion-exchanged water to adjust the solid concentration of the suspension to 20%. The material was then dried in a spray dryer (available from Yamato Kagaku K.K.) whose inlet temperature had been adjusted to 180° C. to obtain a dried powder of capsule grains.

Wet-pulverizing of lubricant grains

Into a 300-ml ball mill were charged 100 g of an ion-exchanged water, 10 g of zinc stearate ( ZnSt, available from Nitto Kasei K.K.), 1 g of sodium dodecylsulfate, and steal balls. These materials were then pulverized for 3 days. The resulting slurry was then freeze-dried to obtain a dried powder.

Preparation of toner

To 400 g of the foregoing capsule grains were added 4 g of carbon black (Vulcan P, available from Cabot Co.) which had been thoroughly crushed by means of a Henschel mixer (available from Mitsui Miike Kakoki K.K.) and 6 g of the foregoing zinc stearate as a lubricant. The mixture was then stirred by means of a twin-cylinder mixer for 6 hours. The mixture was then passed through a 75-μm mesh sieve to obtain a toner.

Evaluation

The diameter of zinc stearate grains contained in the toner was measured on a photograph taken under a scanning type electron microscope. As a result, 99.5% of the grains had a diameter of 3 μm or less, and the average diameter of the grains was 0.8 μm. The toner had a resistivity of $3.5\times10^3$ Ωcm.

The toner was then subjected to a continuous 100,000-sheet print test in a printer (Type 4075 Printer, available from Xerox Corporation) under a high humidity, normal humidity and low humidity, respectively. As a result, the percent transfer was 98%. When the resulting fixed image was rubbed, the fixing level was the same as that obtained by heat fixing. No image quality change due to humidity or with time was seen except for a low humidity condition under which there was a slight image density drop. There were observed no accumulation of free zinc stearate grains in the printer or attachment of these grains to the development roll. Further, there were observed no image defects such as ghost phenomenon. The toner showed no resistivity change from $3.5\times10^3$ Ωcm.

COMPARATIVE EXAMPLE 1

A toner was prepared and evaluated in the same manner as in Example 1 except that zinc stearate was not pulverized.

The diameter of zinc stearate grains contained in the toner was measured on a photograph taken under a scanning type electron microscope, As a result, there were observed many aggregates having a diameter up to 50 μm. 78% of the grains had a diameter of 3 μm or less, and the average diameter of the grains was 2.1 μm. The toner had a resistivity of $4.5\times10^3$ Ωcm.

The toner was then subjected to a continuous 10,000-sheet print test in a printer (Type 4075 Printer, available from Xerox Corporation) under a high humidity, normal humidity and low humidity, respectively. As a result, the percent transfer was 91%. When the resulting fixed image was rubbed, the fixing level was the same as that obtained by heat fixing. No image quality change due to humidity was observed. However, some development density rise with a lapse of time was observed at the initial stage to cause stain on the nonimage portion. Further, there was observed a light ghost phenomenon. Thereafter, as zinc stearate was accumulated on the development roll, there was a great image density drop. Further, there was a remarkable accumulation of free zinc stearate grains in the printer. After the print test, the toner showed a resistivity drop to $3.2\times10^3$ Ωcm.

EXAMPLE 2

Into a 2-l polyethylene container were charged 500 g of an ion-exchanged water, 50 g of amide oleate (Armoslip CP Powder, available from The Lion Fat and Oil Co., Ltd.) and 10 g of a cationic surface active agent (alkylbenzyldimethylammonium chloride; Sunnysol B-50, available from Kao Co., Ltd.). These materials were then stirred at 10,000 rpm for 30 minutes by means of a polytrone homogenizer (Kinemachika K.K.) to pulverize amide oleate.

To 400 g of the same capsule grains as used in Example 1 were added 4 g of carbon black which had been thoroughly crushed by means of a Henschel mixer (available from Mitsui Miike Kakoki K.K.) and 8 g of the foregoing amide oleate as a lubricant. The mixture was then stirred by means of a twin-cylinder mixer for 6 hours. The mixture was then passed through a 75-μm mesh sieve to obtain a toner.

Evaluation

The diameter of amide oleate grains contained in the toner was measured on a photograph taken under a scanning type electron microscope. As a result, 99.3% of the grains had a diameter of 3 μm or less, and the average diameter of the grains was 1.2 μm. The toner had a resistivity of $3.7\times10^3$ Ωcm.

The toner was then subjected to a continuous 100,000-sheet print test in a printer (Type 4075 Printer, available from Xerox Corporation) under a high humidity, normal humidity and low humidity, respectively. As a result, the percent transfer was 97%. When the resulting fixed image was rubbed, the fixing level was the same as that obtained by heat fixing. No image quality change due to humidity or with time was seen except for a low humidity condition under which there was a slight image density drop. There were observed no accumulation of free amide oleate grains in the printer or attachment of these grains to the development roll. Further, there were observed no image defects such as ghost phenomenon. The toner showed no resistivity change from $3.7\times10^3$ Ωcm.

COMPARATIVE EXAMPLE 2

A toner was prepared and evaluated in the same manner as in Example 2 except that amide oleate was not pulverized.

The diameter of amide oleate grains contained in the toner was measured on a photograph taken under a scanning type electron microscope. As a result, there were observed many aggregates having a diameter up to 100 μm. 68% of the grains had a diameter of 3 μm or less, and the average diameter of the grains was 2.3 μm. The toner had a resistivity of $4.9\times10^3$ Ωcm.

The toner was then subjected to a continuous 100,000-sheet print test in a printer (Type 4075 Printer, available from Xerox Corporation) under a high humidity, normal humidity and low humidity, respectively. As a result, the percent transfer was 93%. When the resulting fixed image was rubbed, the fixing level was the same as that obtained by heat fixing. No image quality change due to humidity was observed. However, some development density rise with a lapse of time was observed at the initial stage to cause stain on the nonimage portion. Further, there was observed a light ghost phenomenon. Thereafter, as amide oleate was accumulated on the development roll, there was a great image density drop. Further, there was a remarkable accumulation of free amide oleate grains in the printer. After the print test, the toner showed a resistivity drop to $3.6\times10^2$ Ωcm.

EXAMPLE 3

Preparation of capsule grains 40 g of a copolymer of 50 parts by weight of lauryl methacrylate and 50 parts by weight of styrene (MW: $8\times10^4$; glass transition temperature Tg: −10° C.) was dissolved in a mixture of 27 g of an aliphatic saturated hydrocarbon solvent (Isopar H, available from Exxon Chemical Co.) and 45 g of ethyl acetate. To the solution was then added 80 g of a magnetic powder (EPT-1000, available from Toda Kogyo K.K.). The mixture was then subjected to dispersion by means of a ball mill for 20 hours. To 100 g of the dispersion were then added 15 g of an isocyanate (Sumidur L, available from Sumitomo Beyer Urethane K.K.) and 15 g of ethyl acetate. The mixture was then thoroughly stirred to obtain Solution A.

10 g of hydroxypropyl methyl cellulose (Metrose 65SH50, available from The Shin-etsu Chemical Industry Co., Ltd.) was dissolved in 200 g of an ion-exchanged water. The solution was then cooled to a temperature of 5° C. to obtain Solution B. Solution A was then slowly added to Solution B while the latter was stirred by means of an emulsifier (autohomomixer, available from Tokushu Kika Kogyo K.K.) to effect emulsification. Thus, an O/W emulsion containing oil droplets having an average grain diameter of about 12 μm was obtained.

The emulsion thus obtained was then stirred at 400 rpm by means of an agitator equipped with propeller blades (Three-One Motor, available from Shinto Kagaku K.K.) instead of the foregoing emulsifier. After 10 minutes, 100 g of a 5% aqueous solution of diethylenetriamine was added dropwise to the emulsion. After the completion of the dropwise addition, the emulsion was allowed to undergo capsulization reaction at an elevated temperature of 60° C. while ethyl acetate was being bubbled out for 3 hours. After the completion of the reaction, the product was then poured into 2 l of an ion-exchanged water. The mixture was then thoroughly stirred and allowed to stand. After the capsule grains were sedimented, the supernatant fraction was then removed. This procedure was repeated several times to wash the capsule grains. The capsule grains were then passed through a 75-μm mesh sieve to remove coarse grains. To the resulting capsule grain suspension was then added an ion-exchanged water to adjust the solid concentration of the suspension to 20%. The material was then dried in a spray dryer (available from Yamato Kagaku K.K.) whose inlet temperature had been adjusted to 180° C. to obtain a dried powder of capsule grains.

Wet-pulverizing of lubricant grains

Into a 300-ml ball mill were charged 100 g of an ion-exchanged water, 10 g of zinc stearate (ZnSt, available from Nitto Kasei K.K.), 1 g of sodium dodecylsulfate, and steal balls. These materials were then pulverized for 3 days. The resulting slurry was then freeze-dried to obtain a dried powder.

Preparation of toner

To 100 g of the foregoing dried powder of capsule grains were added 1 g of carbon black (Vulcan P, available from Cabot Co.) which had been thoroughly crushed by means of a Henschel mixer (available from Mitsui Miike Kakoki K.K.) and 1.5 g of the foregoing zinc stearate. The mixture was then stirred by means of a twin-cylinder mixer for 6 hours. The mixture was then passed through a 75-μm mesh sieve to obtain a toner.

Evaluation

The diameter of zinc stearate grains contained in the toner was measured on a photograph taken under a scanning type electron microscope. As a result, 99.5% of the grains had a diameter of 3 μm or less, and the average diameter of the grains was 0.8 μm. The toner had a resistivity of $3.6\times10^3$ Ωcm.

The toner was then subjected to a continuous 100,000-sheet print test in a printer (Type 4075 Printer, available from Xerox Corporation) under a high humidity, normal humidity and low humidity, respectively. As a result, the percent transfer was 97%. When the resulting fixed image was rubbed, the fixing level was the same as that obtained by heat fixing. No image quality change due to humidity or with time was seen except for a low humidity condition under which there was a slight image density drop. There were observed no accumulation of free zinc stearate grains in the printer or attachment of these grains to the development roll. Further, there were observed no image defects such as ghost phenomenon. The toner showed no resistivity change from $3.6\times10^3$ Ωcm.

As mentioned above, the electrically-conductive toner according to the present invention comprises lubricant grains which is hardly separated therefrom and hardly attached to the development roll, causing no stain in a copying machine or printer. Thus, the electrically-conductive toner according to the present invention causes no deterioration of image quality with time and exhibits excellent transfer and fixing properties. Further, the toner according to the present invention causes no ghost phenomenon. The resulting image density stays stable against the external humidity.

Further, the electrically-conductive toner according to the present invention is suitable as a capsule toner for use in image formation process using the simultaneous pressure transfer and fixing process or heat-assisted simultaneous pressure transfer and fixing process but also the heat-assisted simultaneous transfer and fixing process.

While the invention has been described in detail and with reference to specific embodiments thereof, it will be apparent to one skilled in the art that various changes and modifications can be made therein without departing from the spirit and scope thereof.

What is claimed is:

1. An electrically-conductive toner comprising toner mother grains and a lubricant which is at least one selected from the group consisting of an aliphatic acid, an aliphatic acid metal salt, an aliphatic alcohol, an aliphatic amide, an aliphatic bisamide, and an aliphatic acid ester, said lubricant being in the form of finely divided grains having such a diameter that at least 99% by number of said finely divided grains have a diameter of 3 μm or less.

2. An electrically-conductive toner as claimed in claim 1, wherein the surface of said lubricant grains is coated with a surface active agent.

3. An electrically-conductive toner comprising toner mother grains and finely divided lubricant grains, said finely divided lubricant grains being obtained by wet-pulverizing a lubricant in the presence of a surface active agent.

4. An electrically-conducive toner as claimed in claim 3, wherein said lubricant is at least one selected from the group consisting of an aliphatic acid, an aliphatic metal salt, an aliphatic alcohol, an aliphatic amide, an aliphatic bisamide, and an aliphatic ester.

5. An electrically-conducive toner as claimed in claim 3, wherein at least 99% by number of said finely divided lubricant grains have a diameter of 3 μm or less.

6. A process for the preparation of an electrically-conductive toner comprising toner mother grains and finely divided lubricant grains, said process comprising the steps of:

preparing toner mother grains;

wet-pulverizing a lubricant in the presence of a surface active agent to obtain finely divided lubricant grains; and mixing said toner mother grains with said finely divided lubricant grains to cause said finely divided lubricant grains to be attached or fixed to said toner mother grains.

7. A process for the formation of an image which comprises the steps of:

forming a latent image on a latent image carrier;

developing said latent image with a toner; and transferring said developed toner image to a transfer material by means of a pressing member, said toner being an electrically-conductive toner comprising toner mother grains and a lubricant which is at least one selected from the group consisting of an aliphatic acid, an aliphatic acid metal salt, an aliphatic alcohol, an aliphatic amide, an aliphatic bisamide, and an aliphatic acid ester, said lubricant is in the form of finely divided grains having such a diameter that at least 99% by number of said finely divided grains have a diameter of 3 μm or less.

8. A process for the formation of an image as claimed in claim 7, wherein said pressing member comprises a heating means thereinside.

9. A process for the formation of an image which comprises the steps of:

forming a latent image on a latent image carrier;

developing said latent image with a toner; and transferring said developed toner image to a transfer material by means of a pressing member, said toner being an electrically-conductive toner comprising toner mother grains and finely divided lubricant grains, said finely divided lubricant grains being obtained by wet-pulverizing a lubricant in the presence of a surface active agent.

10. A process for the formation of an image as claimed in claim 9, wherein said pressing member comprises a heating means thereinside.

11. An electrically-conductive toner as claimed in claim 2, wherein the surface active agent is an anionic surface active agent.

12. An electrically-conductive toner as claimed in claim 2, wherein the surface active agent is an ester of sulfuric acid.

13. An electrically-conductive toner as claimed in claim 3, wherein the surface active agent is an anionic surface active agent.

14. An electrically-conductive toner as claimed in claim 3, wherein the surface active agent is an ester of sulfuric acid.

15. A process as claimed in claim 7, wherein the surface of said lubricant grains is coated with a surface active agent.

* * * * *